US005577850A

United States Patent [19]

Mishima

[11] Patent Number: 5,577,850

[45] Date of Patent: Nov. 26, 1996

[54] RODLIKE BODY FEEDING DEVICE

[75] Inventor: Shingo Mishima, Ishioka, Japan

[73] Assignee: Pentel Kabushiki Kaisha, Japan

[21] Appl. No.: 211,464

[22] PCT Filed: Jul. 27, 1993

[86] PCT No.: PCT/JP93/01054

§ 371 Date: Mar. 30, 1994

§ 102(e) Date: Mar. 30, 1994

[30] Foreign Application Priority Data

| | | | |
|---|---|---|---|
| Jul. 31, 1992 | [JP] | Japan | 4-059571 U |
| Feb. 26, 1993 | [JP] | Japan | 5-013183 U |
| Jun. 30, 1993 | [JP] | Japan | 5-041265 U |

[51] Int. Cl.[6] ..... B43K 21/06; B43K 24/04

[52] U.S. Cl. ..... 401/83; 401/84

[58] Field of Search ..... 401/82, 83, 84

[56] References Cited

U.S. PATENT DOCUMENTS

| | | | |
|---|---|---|---|
| 1,097,238 | 5/1914 | Krell | 401/84 |
| 2,259,133 | 10/1941 | Harper | 401/83 |
| 2,314,777 | 3/1943 | Farrington | 401/83 |
| 3,756,727 | 9/1973 | Gallagher | 401/84 |

FOREIGN PATENT DOCUMENTS

| | | | |
|---|---|---|---|
| 582484 | 10/1929 | Germany | 401/84 |
| 565591 | 7/1957 | Italy | 401/84 |
| 48-98238 | 11/1973 | Japan . | |
| 50-24245 | 3/1975 | Japan . | |
| 63-31992 | 8/1988 | Japan . | |
| 4-23036 | 5/1992 | Japan . | |
| 4-38239 | 6/1992 | Japan . | |
| 3071 | 12/1863 | United Kingdom | 401/83 |

*Primary Examiner*—Steven A. Bratlie
*Attorney, Agent, or Firm*—Adams & Wilks

[57] ABSTRACT

A device for feeding an elongate member comprises a tubular member having a slit extending in the axial direction thereof and locking portions arranged in the axial direction of the tubular member, and a slider disposed in the tubular member for sliding movement along the axial direction of the tubular member. The slider has a fastening portion for holding the elongated member, a slider body portion and a retraction preventing portion. The fastening portion and retraction preventing portion are connected together by an elastic portion, and the retraction preventing portion and slider body portion are connected together by an elastic portion.

19 Claims, 6 Drawing Sheets

RODLIKE BODY FEEDING DEVICE

TECHNICAL FIELD OF THE INVENTION

This invention relates to a device for feeding a longitudinal rodlike body, such as a lipstick, a crayon, a pastel and an eraser, and more particularly to a rodlike body feeding device capable of extending and retracting a rodlike body from and into a case easily, and preventing the unintentional retraction of the rodlike body when in use.

BACKGROUND OF THE INVENTION

Japanese Patent Publication No. 38239/1992 discloses a rodlike body feeding device consisting of a tubular shaft provided with a slit extending in the axial direction of the tubular shaft, and a plurality of engageable portions provided in the same axial direction; and a slider provided slidably in the tubular shaft and having a rodlike body-fastening portion.

This prior art publication is directed to a holder for a rodlike body, and the holder has a slider provided in the tubular shaft slidably in the axial direction, operable via a push-button, and fixable in an engagement position. The slider, mainly together with a tightening member, other than the push-button, constitutes a two-arm lever, and the two-arm lever can be turned around a common pivot. In order to convert a pressing force, which is exerted on a receiving member in the axial direction thereof, into a radially acting force and to transmit the converted force, the receiving member and the tightening member are movably connected via the above-mentioned pivot. The tubular shaft is provided with a tightened surface or a locking hole and a guide slit. The guide slit is so provided as to face to the tightened surface or locking hole. The object of adopting such a structure is to provide a holder for a rodlike member, the holder having a simple structure, such that, for example, the device can be easily operated by applying a pressure to the push-button in the axial and/or radial direction, and the rodlike member to be supported can be supported when an axial force is applied to the rodlike member.

However, in order to retract a rodlike body into the conventional rodlike body feeding device, it is necessary that the push-button (knob) be pressed radially inwardly toward the axis of the shaft (tube) and then moved in the axial direction while releasing the lock for preventing the retraction. Namely, the operability of this type of device needs improvement.

SUMMARY OF THE INVENTION

An object of the present invention is, in view of the complicated operation of the conventional device of this kind, to provide a rodlike body feeding device in which the rodlike body can be easily retracted, but which is not retracted during the use of the device.

Another object of the present invention is to provide an improved rodlike feeding body device capable of feeding a rodlike body comfortably with a light "click" sound even after the device has been used for a long time.

The present invention has been developed with a view to attaining these objects, and is directed to a rodlike body feeding device comprising a tubular shaft provided with a slit extending in the axial direction of the tubular shaft, and a plurality of locking portions arranged in the same axial direction, and a slider provided slidably in the tubular shaft and having a rodlike body fastening portion. The slider comprises a rodlike body fastening portion, a retraction preventing portion and a slider body in such a manner that the fastening portion and retraction preventing portion are connected with each other by an elastic body, and similarly the retraction preventing portion and slider body are connected with each other by an elastic member.

Since the rodlike fastening portion and retraction preventing portion are connected together, and the retraction preventing portion and slider body are connected together by the elastic members, respectively, the retraction preventing portion and the locking portions are not engaged while the rodlike body is being slid out or retracted, so that the feeding and retraction of the rodlike body can be accomplished by only the application of an axial force. When the device is in use, i.e., when the rodlike body is projected to a feedout position and pressed against, for example, the surface of paper, the retraction preventing portion receives a compressive force from the body fastening portion and slider body due to the reaction of the paper-pressing force, and is displaced toward the axis of the tubular shaft to be engaged with the locking portions thereof. Accordingly, unintentional retraction of the rodlike body can be prevented.

In another embodiment of the present invention, a rodlike body feeding device comprises a tubular shaft provided with a slit extending in the axial direction of the tubular shaft, and a plurality of locking portions provided in the same axial direction, and a slider provided slidably in the tubular shaft and having a rodlike body-fastening portion, and has a structure in which the slider comprises a rodlike body fastening portion, a retraction preventing portion connected elastically to the body fastening portion, and a tubular slider body connected elastically to the retraction preventing portion. A spring member is housed in the slider body in such a manner that the locking portion having a locking portion projects from a window provided in a side wall of the slider body, and is engaged with one of the above-mentioned locking portions.

By this structure, unintentional retraction of the rodlike body can be prevented, and, moreover, the shoulder portions of the spring member which are on the lower side of the locking portion thereof are in contact with the inner surface of the slider body since the spring member is housed in the slider body in a state that the locking portion projects from the window provided in the side wall of the slider body. When the rodlike body is projected or retracted, the locking portion of the spring member engages with and disengages from one of the locking portions of the tubular shaft continuously, so that the spring member is moved repeatedly in the radial, i.e. vertical direction. During this time, the shoulder portions of the spring member impinge upon the inner surface of the slider body to generate light click sounds, and the device can thus be operated comfortably. Since both shoulder portions of the spring member impinge upon the inner surface of the slider body, clear click sounds can be generated as compared with a case where only one shoulder portion impinges upon the inner surface. The part upon which the spring member impinges is the inner surface of the wall of the slider body which can be thickened, so that the device is durable for a long time.

In still another embodiment of the present invention, a rodlike body feeding device comprises a tubular shaft provide with a slit extending in the axial direction of the tubular shaft, and a plurality of locking portions provided in the same axial direction, and a slider provided slidably in the tubular shaft and having a rodlike body-fastening portion. In this embodiment of the invention, the slider comprises a rodlike body fastening portion, a retraction preventing portion connected pivotably to the body fastening portion, and a slider body connected pivotally to the retraction preventing portion.

By this arrangement, the retraction preventing portion and the locking portion of the tubular shaft are not engaged with each other during the rodlike body feeding and retraction operations, so that rodllke body can be fed out and retracted by applying an axial force only to the knob. When the device is in use, the retraction preventing portion receives a compressive force from the body fastening portion and slider body due to the reaction of the paper pressing force, and is displaced toward the axis of the tubular shaft to be engaged with a locking portion thereof. Accordingly, the retraction of the rodlike body can be prevented.

DETAILED DESCRIPTION OF PREFERRED EMBODIMENTS

Preferred embodiments of the present invention will now be described with reference to the drawings.

Referring to FIGS. 1–4, a flat surface portion 1*a* is formed on the outer surface of a tubular shaft 1, so that the flat surface portion 1*a* extends in the axial direction thereof. The flat surface portion 1*a* has a slit 2 having on both sides thereof a plurality of mutually-facing pairs of locking portions 2*a* consisting of rectangular recesses.

In the tubular shaft 1, slidably provided is a slider 3, which has a fastening portion 3*a* to which a rodlike body A, such as a lipstick, a crayon, a pastel, an eraser and a cutting blade is fixed. In this slider 3, the part of the fastening portion 3*a*, to which the rodlike body A is fastened, which is on the opposite side of the locking portions 2*a*, and the part of a retraction preventing portion 3*b*, on which a projection 3*d* constituting locking means is formed, which is on the opposite side of the locking portions 2*a*, are connected to each other by an elastic platelike member 3*e* at a lower position of the platelike member. The part of the retraction preventing portion 3*b* which is close to the locking portions 2*a*, and the part of a slider body 3*c* which is close to the locking portions 2*a* are connected to each other by an elastic platelike member 3*f* at an upper position of the platelike member.

Figure 5:
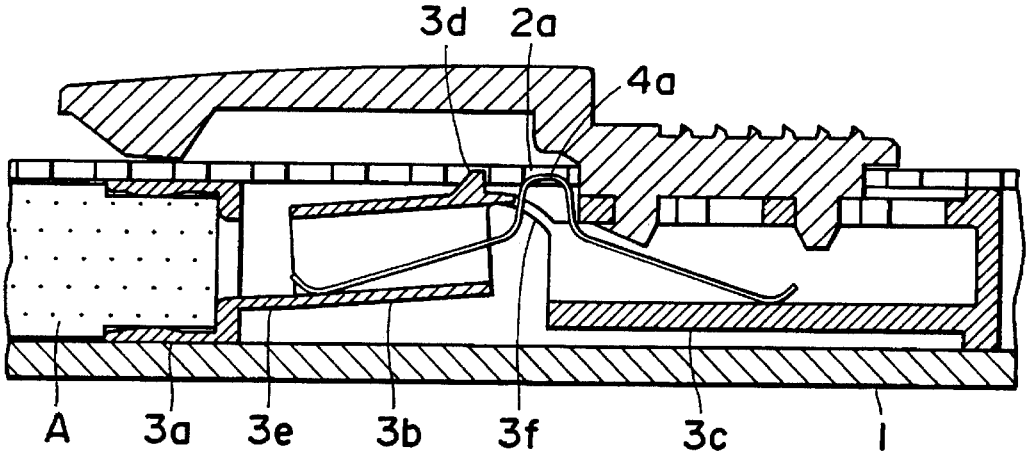
FIG. 5 illustrates a retraction preventing mechanism shown in FIG. 2.

As shown in FIG. 5, spring member (for example, a leaf spring) 4 has a locking portion 4*a* engageable with a locking portion 2*a* formed in the tubular shaft 1 and the spring member 4 is disposed in the interior of the retraction preventing portion 3*b* and slider body 3*c* so that the spring member 4 forms a "mountain" shape. The locking portion 4*a* of this spring member 4 can be engaged with a locking portion 2*a* formed in the tubular shaft 1 through a hole 3*g* made in the central part of the platelike portion 3*f* by which the retraction preventing portion 3*b* and slider body 3*c* are connected together. A knob 5 of a clip 6 is fixed to the slider body 3*c* at its leg portion 5*a* extending inward through the slit 2.

The locking portion 4*a* may be a projection capable of entering a locking portion 2*a*, and, when the operability of the device during the feeding and retraction of the rodlike body A is taken into consideration, it is preferable that the locking portion 4*a* has a curved or inclined surface. In view of the effect in preventing the retraction of the rodlike body A, it is preferable that the feeding-side surface (front surface) of the projection 3*d* constituting a locking portion is a curved or inclined surface, and that the retraction-side surface (rear surface) thereof is a substantially vertical surface when viewing the feeding device in the horizontal orientation shown in FIG. 5. The tubular shaft 1 can employ any of other suitable cross-sectional shapes, such as a square or flat (oval) cross-sectional shape.

Figure 1:
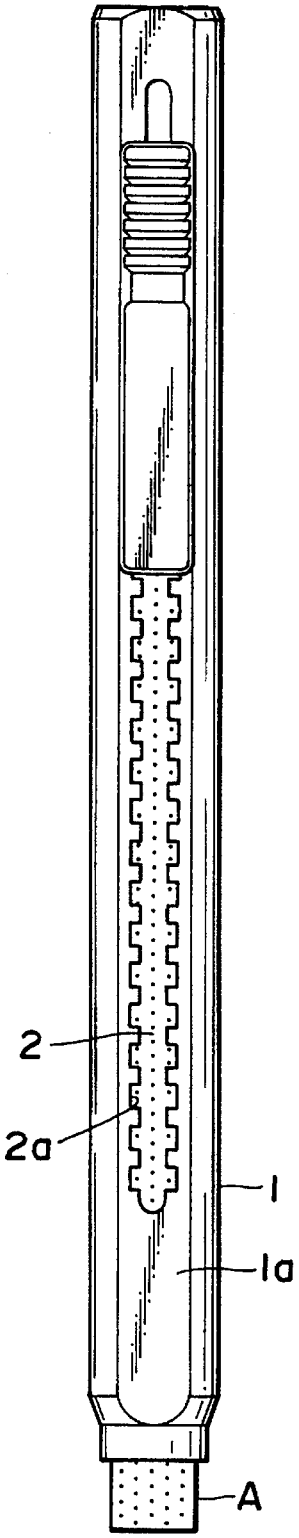
FIG. 1 is a front elevation of a rodlike body feeding device according to a first embodiment of the present invention.
Figure 2:
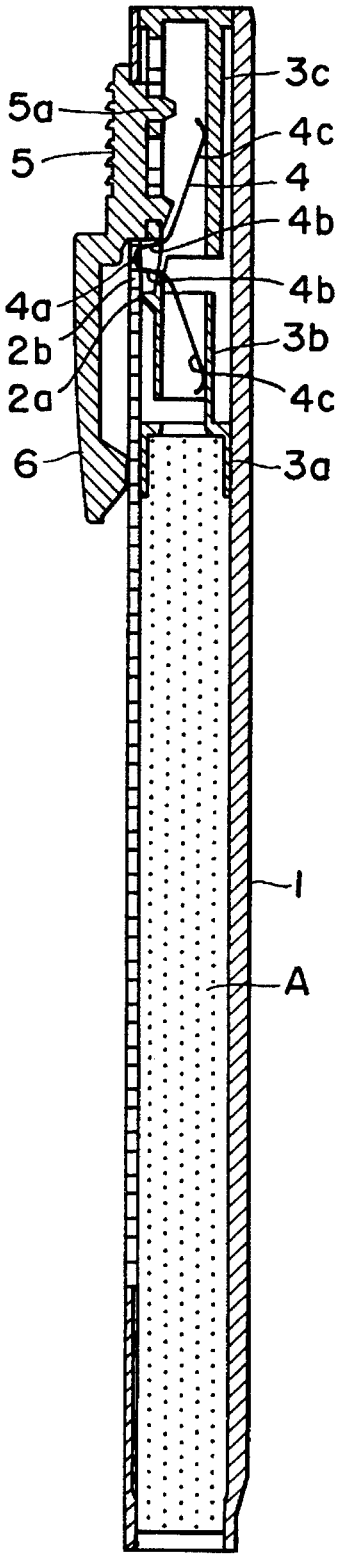
FIG. 2 is a longitudinal section of the rodlike body feeding device shown in FIG. 1.
Figure 3:
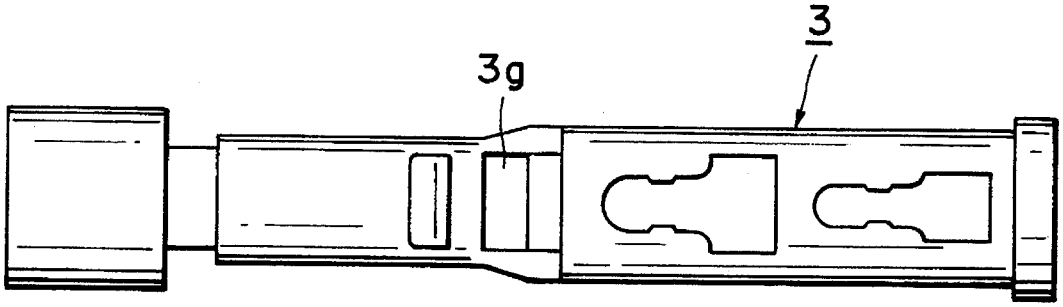
FIG. 3 and 4 are a front elevation and a side elevation, respectively, of a slider in the first embodiment.
Figure 4:
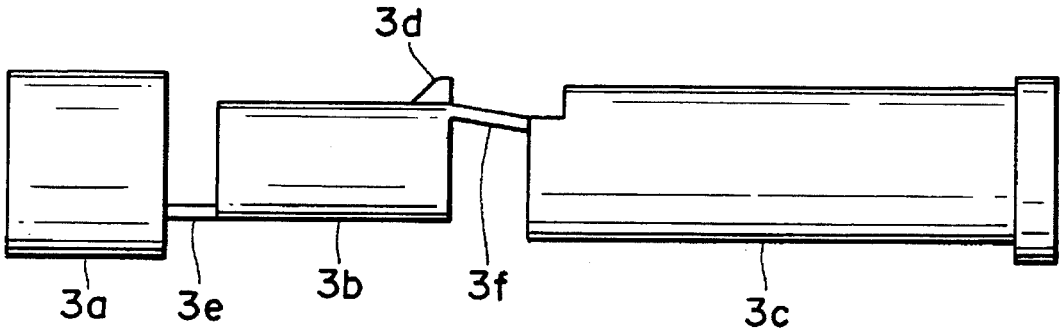

An operation of the device will now be described. Referring to FIG. 2 which shows the device in a rest state, the retraction preventing portion 3*b* does not receive any force from the fastening portion 3*a* and slider body 3*c*, so that the projection 3*d* constituting a locking portion is not in engagement with a locking portion 2*a*. When a pressing force is applied to the knob 5 in the moving direction of the rodlike body A so as to feed or retract the rodlike body A, the locking portion 4*a* is displaced toward the axis of the tubular shaft (i.e., in the radially inward direction of the tubular shaft) and disengaged from a locking portion 2*a*. During this time, the retraction preventing portion 3*b* receives only a force applied in one direction, so that the projection 3*d* constituting a locking portion does not engage a locking portion 2*a*. When the device is in use, i.e., when the rodlike body A is projected outward and pressed on the surface of paper, the reaction force which is equal to the pressing force applied to the surface of the paper is exerted on the rodlike body A. Therefore, a force acting to retract the rodlike body A is exerted on the slider 3. However, since an engagement force of the locking portion 4*a* with respect to a locking portion 2*a* is exerted on the slider body 3*c*, the retraction preventing portion 3*b* receives a compressive force from the fastening portion 3*a* and slider body 3*c* and is displaced radially outwardly, so that a locking portion 2*a* and the projection 3*d* are engaged with each other as shown in FIG. 5. This prevents the retraction of the rodlike body A during use of the feeding device. When the rodlike body A is displaced away from the surface of the paper after the device is used, the reaction force described above is lost, and a pressure difference between the locking portion 2*a* of the tubular shaft 1 and the projection 3*d* constituting a locking portion is also lost. Consequently, the retraction preventing portion 3*b* returns to the original position and is disengaged from the locking portion 2*a*, so that the rodlike body A can be easily retracted into the tubular shaft 1.

Figure 6:
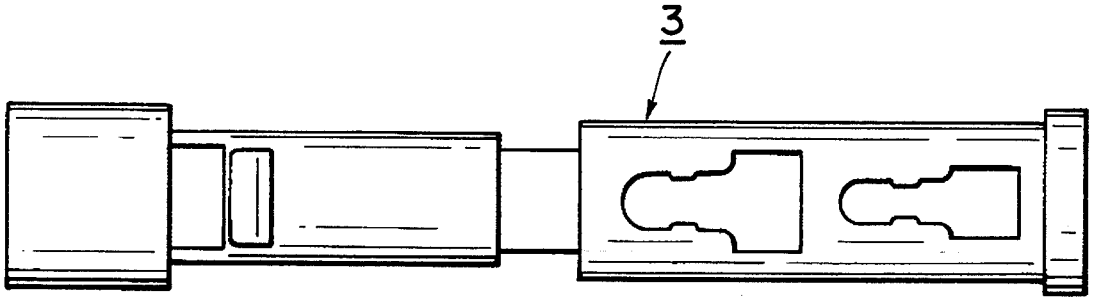
FIGS. 6 and 7 are a front elevation and a side elevation, respectively, of a slider in a modified example of the first embodiment.
Figure 7:
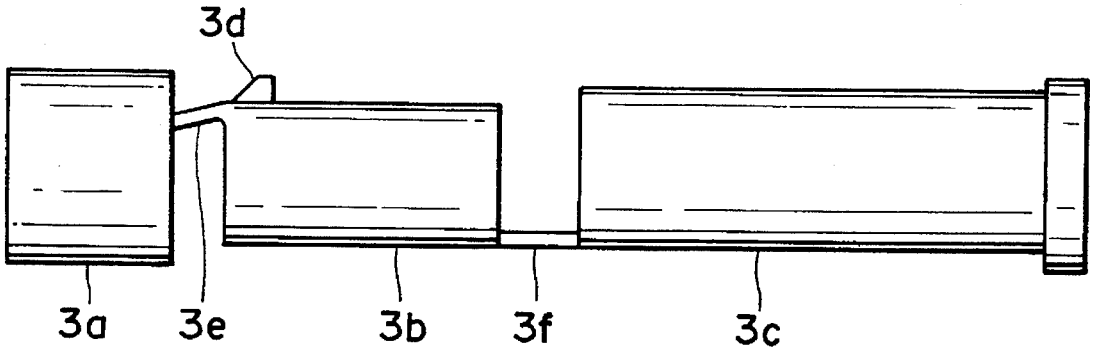

Referring to FIGS. 6 and 7 showing a modified example of this embodiment, a platelike portion 3*e* of an elastic material for connecting a fastening portion 3*a* of a slider 3 and a retraction preventing portion 3*b* together is positioned close to the locking portions 2*a*, and a platelike portion 3*f* of an elastic material for connecting the retraction preventing portion 3*b* and a slider body 3*c* together is positioned on the opposite side of the locking portions 2*a*. Accordingly, this modified example is identical with the previously-described embodiment except that a projection 3*d* serving as a locking portion is formed on the part of the retraction preventing portion 3*b* which is near the fastening portion 3*a*, and the operation and effect of this modified example are also substantially identical with those of the previous embodiment.

Figure 8:
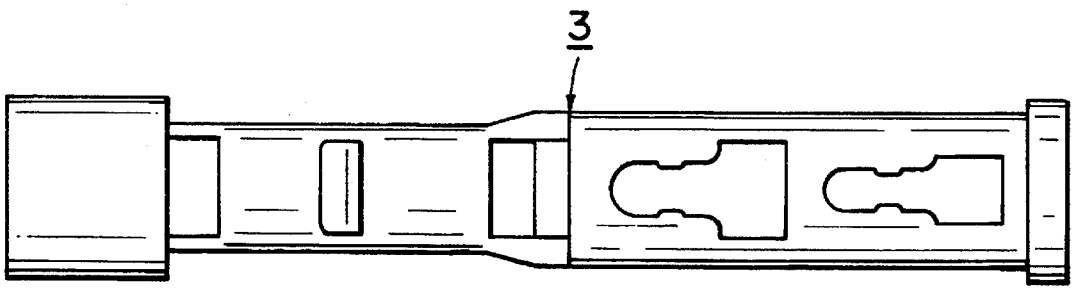
FIGS. 8 and 9 are a front elevation and a side elevation, respectively, of a slider of another modified example of the first embodiment.
Figure 9:
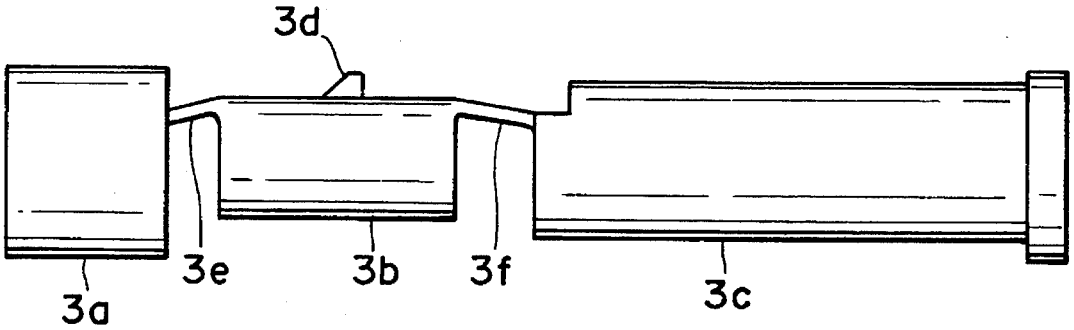

Referring to FIGS. 8 and 9 which show another modified example, both a platelike portion 3*e* of an elastic material for connecting a fastening portion 3*a* of a slider 3 and a retraction preventing portion 3*b* together, and a platelike portion 3*f* of an elastic material for connecting the retraction preventing portion 3*b* and a slider body 3*c* together are formed close to locking portions 2*a*. Accordingly, this modified example is identical with the first embodiment except that a projection 3*d* constituting a locking portion is formed on the substantially central part of the retraction preventing portion 3*b*, and the operation and effect of the modified example are identical with those of the first embodiment.

Figure 9A:
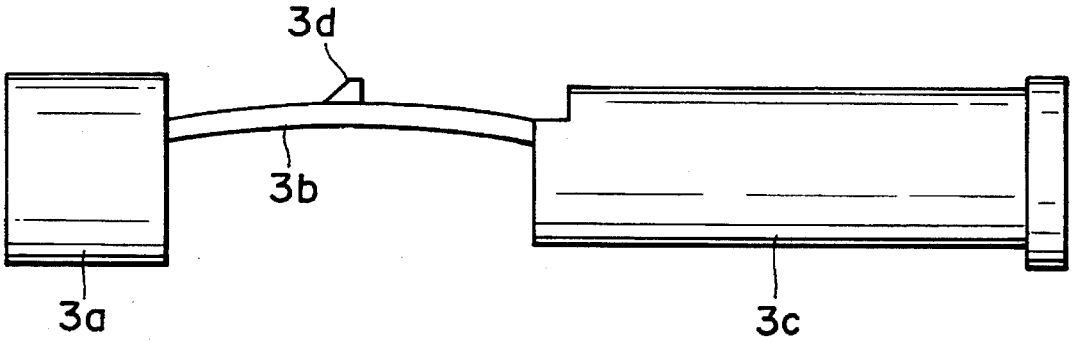
FIG. 9A is a side elevation of the slider of still another modified example.

FIG. 9A shows still another modified example.

In this modified example, a fastening portion 3*a* of a slider and a slider body 3*c* are connected together by a retraction preventing portion 3*b* comprising an elastic plate member, and a projection 3*d* constituting a locking portion is formed on the substantially central part of this retraction preventing portion 3*b*. This modified example is identical with the above-described embodiment except that the retraction preventing portion 3*b* is so formed as to be curved arcuately and the projection 3*d* is formed outside the arcuately formed retraction preventing portion 3*b*. The operation and effect of this modified example are also substantially identical with those of the first embodiment.

Although in the example shown in FIG. 9 only one retraction preventing portion 3*b* is provided, two retraction preventing portions may also be provided. When two retraction preventing portions are provided, the fastening portion 3*a* of the slider and the slider body 3*c* are connected together at their lower parts by the retraction preventing portions 3*b*, and projections 3*d* constituting locking portions are formed on the substantially central parts of the lower sides of the retraction preventing portions 3*b*. In this case the projections 3*d* constituting downwardly extending locking portions contact the inner surface of the tubular shaft and generate frictional resistance, so that the retraction of a rodlike body A can be prevented more reliably. There are some cases where the retraction of a certain kind of rodlike body can be prevented to a certain extent even by only the friction between the retraction preventing portions and the inner surface of the tubular shaft. In such cases, the projection is not necessarily formed on the retraction preventing portions 3*b*.

Figure 10:
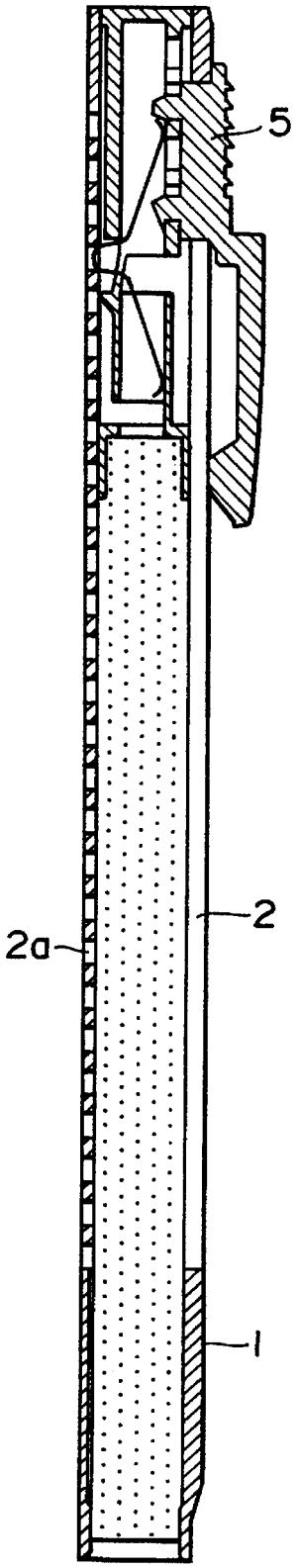
FIG. 10 is a longitudinal section of a modified example of the rodlike body feeding device of FIG. 2.

FIG. 10 is a longitudinal section showing a modified example of the rodlike body feeding device of FIG. 2. In this modified example, a slit 2 and locking portions 2*a* consisting of a plurality of holes are formed in a tubular shaft so that the slit 2 and locking portions 2*a* are positioned in a confronting relation with each other. Therefore, the construction, operation and effect of this modified example are identical with those of the first embodiment except that a knob 5 is provided on the opposite side of the locking portions 2*a*. The locking portions may be bores or recesses aligned longitudinally other than the illustrated examples.

Figure 11:
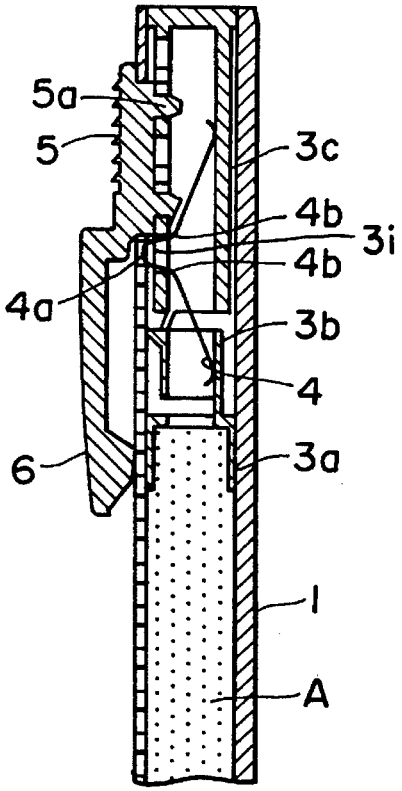
FIG. 11 is a longitudinal section showing a part of a rodlike body feeding device according to a second embodiment of the present invention.
Figure 12:
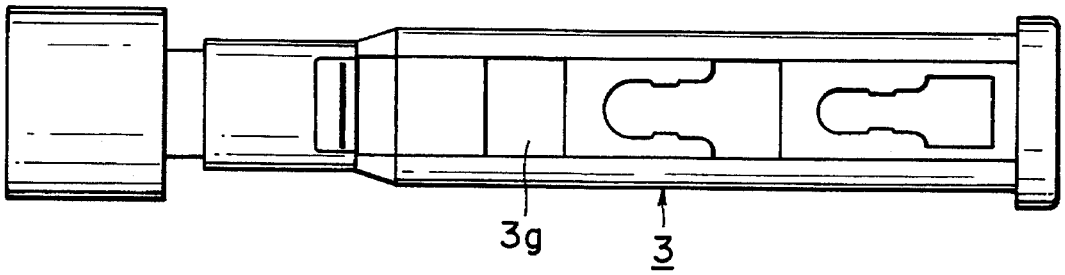
FIGS. 12 and 13 are a front elevation and a side elevation, respectively, of a slider employed in the second embodiment of the rodlike body feeding device.

A second embodiment of the present invention shown in FIGS. 11–13 will now be described. In this embodiment, a slider 3 is so formed that a retraction preventing portion 3*b* on which a projection 3*d* is formed is connected resiliently by a platelike portion 3*e* to a fastening portion 3*a* to which a rodlike body A if fastened, and a slider body 3*c* is joined resiliently to this retraction preventing portion 3*b* by a platelike portion 3*f*. A spring member 4 of a leaf spring having a locking portion 4*a* engageable with the locking portions 2*a* formed in a tubular shaft 1 is provided in the interior of the slider body 3*c* in such a manner that the spring member 4 forms a "mountain" shape. The locking portion 4*a* of the spring member 4 is projected from a window 3*i* provided in a side wall of the slide body 3*c* and engageable with a locking portion 2*a* in the tubular shaft 1, and the shoulder portions 4*b* of the spring member 4 contact the inner surface of the slider body 3*c*. A knob 5 of a clip 6 is fixed at its leg portions 5*a*, extending downward through a slit 2 to the slider body 3*c*.

Figure 13:
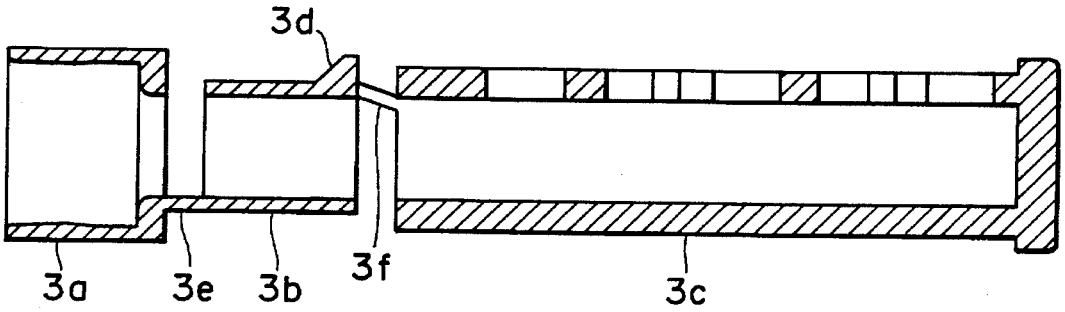

As best shown in FIG. 13, the locking portion 4*a* of the spring member 4 may be a projection capable of entering a locking portion 2*a*, and, when the operability of the device during the feeding and retraction of the rodlike body A is taken into consideration, it is preferable that the side surface of the locking portion 4*a* has a curved or inclined surface. In view of the effect in preventing the retraction of the rodlike body A, it is preferable that the feeding (front) surface of the projection 3*d* constituting a locking portion has a curved or inclined surface, and that the retraction-side (rear) surface thereof has a substantially vertical surface, in the same manner as in the previously-described embodiment.

Since an operation of the device in this embodiment is identical with that of the previously-described embodiment shown in, for example, FIG. 5, the detailed description thereof is omitted. When the device is in use, i.e., when the rodlike body A is projected outward and contacts the surface of paper, the reaction force which is equal to the pressing force applied to the surface of the paper is exerted on the rodlike body A. Therefore, a force for retracting the rodlike body A is exerted on the slider 3. However, since a force of engagement of the locking portion 4*a* with a locking portion 2*a* is exerted on the slider body 3*c*, the retraction preventing portion 3*b* receives a compressive force from the fastening portion 3*a* and slider body 3*c* and is displaced radially outwardly, so that the locking portion 2*a* and the projection 3*d* constituting a locking portion are engaged with each other as shown in FIG. 5. This enables the retraction of the rodlike body A to be prevented.

When a pressing force is applied in the operating direction to the knob 5 fixed to the slider body 3*c* so as to slide the rodlike body A out or retract it, the locking portion 4*a* of the spring member 4 is displaced inwardly toward the axis of the tubular shaft (i.e., in the radially inward direction) against the elastic force of the spring member 4, so that the locking portion 4*a* is disengaged from a first locking portion 2*a* with which it is engaged and engages another locking portion 2*a* adjacent to the first locking portion 2*a* in accordance with the movement of the slider 3. During this time, the two shoulder portions 4*b* of the spring member 4 impinge upon the inner surface of the thick wall of the slider body 3*c* and generate light and pleasant click sounds. Therefore, the device can withstand-long-term use sufficiently.

Figure 14:
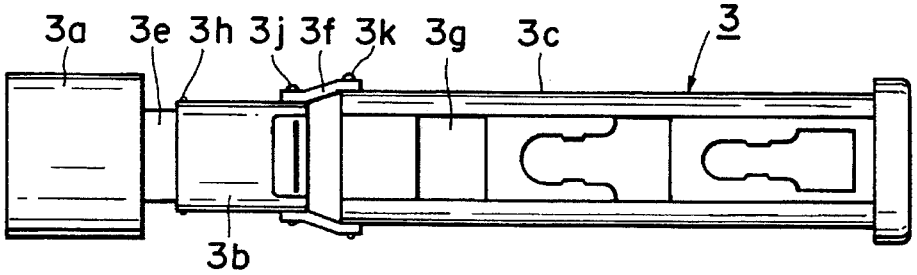
FIGS. 14 and 15 are a front elevation and a side elevation, respectively, of a slider of another embodiment.
Figure 15:
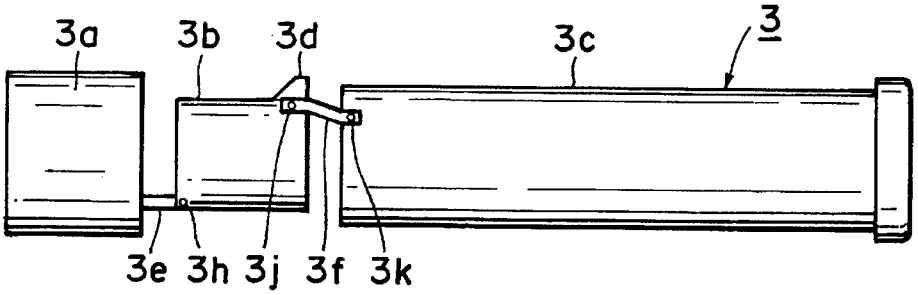

Referring to FIGS. 14 and 15 which show another embodiment of the present invention, a platelike portion 3*e* extending rearwardly from a portion 3*a*, to which a rodlike body A is fastened, of a slider 3 and a retraction preventing portion 3*b* on which a projection 3*d* constituting a locking portion is formed are connected pivotally by connecting members 3*h*, such as bolts or screw, and this retraction preventing portion 3*b* and a slider body 3*c* are pivotally connected by a connecting portion 3*f* through connecting members 3*j*, 3*k* such as bolts or screws. Although the platelike portion 3*e* formed integrally with the fastening portion 3*a* is illustrated as an example, it can also be formed separately from the fastening portion 3*a*. When the platelike portion 3*e* is formed separately from the fastening portion 3*a*, they may be fixedly or pivotally connected together.

Since the construction of the other parts of the feeding device in this embodiment are identical with that of the corresponding parts of the previously-described embodiments, the detailed description thereof will be omitted. An operation of the device in the embodiment of FIGS. 14 and 15 will now be briefly described.

When the device in this embodiment is in use with the rodlike body projected, a reaction force corresponding to the paper-pressing force is exerted on the rodlike body A, so that a force for retracting the rodlike body A is applied to the slider 3. A force due to the engagement of the locking portion 4*a* of a spring member 4 with a locking portion 2*a* of the tubular shaft 1 is imparted to the slider body 3*c*. Accordingly, the retraction preventing portion 3*b* receives a compressive force from the fastening portion 3*a* and slider body 3*c* and is displaced in the radially outward direction (vertically upward as shown in FIG. 15) to cause the locking portion 2*a* of the tubular shaft 1 and the projection 3*d* to be engaged with each other. This can prevent the retraction of the rodlike body A during use thereof. When the rodlike body A is displaced away from the surface of the paper after the device is used, the reaction force described above is lost, and a pressure difference between the locking portion 2*a* of the tubular shaft 1 and the projection 3*d* constituting a locking portion is also lost. Consequently, the retraction preventing portion 3*b* returns to the original position and is disengaged from the locking portion 2*a*, so that the rodlike body A can be easily retracted into the tubular shaft 1. Since the platelike portion 3*e* and connecting portion 3*f* can be formed separately, the material therefor can be selected freely. Therefore, the mechanical strength of the slider can be increased as necessary, and the device can be formed so as to withstand long-term use.

What is claimed is:

1. A feeding device for feeding a rodlike body, comprising: a tubular member having a slit extending in the axial direction of the tubular member, and a plurality of locking portions arranged in the axial direction of the tubular member; and a slider disposed in the tubular member for sliding movement in the axial direction of the tubular member, the slider having a fastening portion for holding the rodlike body, a tubular slider body portion and a retraction preventing portion, the fastening portion and the retraction preventing portion being connected together by a first elastic portion, and the retraction preventing portion and the tubular slider body portion being connected together by a second elastic portion.

2. A feeding device for feeding a rodlike body, comprising: a tubular member having a slit extending in the axial direction of the tubular member, and a plurality of locking portions arranged in the axial direction of the tubular member; and a slider disposed in the tubular member for sliding movement in the axial direction of the tubular member, the slider having a fastening portion for holding the rodlike body, a retraction preventing portion elastically connected to the fastening portion, a tubular slider body portion elastically connected to the retraction preventing portion, and a spring member extending into the tubular slider body and having a locking portion, the locking portion of the spring member projecting from an opening provided in a side wall of the tubular slider body portion for engagement with one of the locking portions of the tubular member.

3. A feeding device for feeding a rodlike body, comprising: a tubular member having a slit extending in the axial direction of the tubular member, and a plurality of locking portions arranged in the axial direction of the tubular member; and a slider disposed in the tubular member for sliding movement in the axial direction of the tubular member, the slider having a fastening portion for holding the rodlike body, a slider body portion and a retraction preventing portion, the fastening portion and the retraction preventing portion being pivotally connected together, and the retraction preventing portion and the slider body portion being pivotally connected together.

4. A feeding device as claimed in claim 1; further comprising an operating member movable in the axial direction of the tubular member, the operating member being connected to the slider for sliding the slider during movement of the operating member in only the axial direction of the tubular member.

5. A feeding device as claimed in claim 4; wherein the operating member is fixed to the tubular slider body portion of the slider.

6. A feeding device as claimed in claim 4; further comprising a spring member disposed in the tubular member and in engagement with the slider, the spring member having a locking portion for engagement with the locking portions of the tubular member when the operating member slides the slider in the axial direction of the tubular member.

7. A feeding device as claimed in claim 1; wherein the retraction preventing portion of the slider has a projection for engagement with the locking portions of the tubular member upon application of a compressive force on the rodlike body in the axial direction of the tubular member.

8. A feeding device as claimed 7; further comprising a spring member disposed in the tubular member and in engagement with the slider, the spring member having a locking portion for engagement with the locking portions of the tubular member during sliding movement of the slider in the axial direction of the tubular member.

9. A feeding device as claimed in claim 8; wherein the spring member has a first leg portion engaging the tubular slider body, and a second leg portion engaging the retraction preventing portion.

10. A feeding device as claimed in claim 9; wherein the second elastic portion of the slider has an opening, and the locking portion of the spring member extends through said opening.

11. A feeding device for feeding a body, comprising: a tubular member having a plurality of locking portions arranged in the axial direction of the tubular member; a slider disposed in the tubular member for sliding movement in first and second directions along the axial direction of the tubular member, the slider having a fastening portion for holding a body to be fed, a projection for engagement with the locking portions of the tubular member only upon application of a force on the body tending to slide the slider in the second direction, a slider body portion, an intermediate body portion supporting the projection, a first elastic portion connecting the fastening portion to the intermediate body portion, and a second elastic portion connecting the slider body portion to the intermediate body portion; and a spring member disposed in the tubular member and engaging the slider, the spring member having a locking portion for engagement with the locking portions of the tubular member during sliding movement of the slider in the first and second directions.

12. A feeding device as claimed in claim 11; wherein the spring member has a first leg portion and a second leg portion, the first leg portion engaging the intermediate body portion of the slider, and the second leg portion engaging the slider body portion of the slider.

13. A feeding device as claimed in claim 12; wherein the second elastic portion of the slider has an opening, and the locking portion of the spring member extends through the opening.

14. A feeding device as claimed in claim 12; wherein the slider body portion has an opening, and the locking portion of the spring member extends through the opening.

15. A feeding device as claimed in claim 11; wherein the projection of the slider is disposed closer to the second elastic portion than to the first elastic portion.

16. A feeding device as claimed in claim 11; wherein the projection of the slider is disposed closer to the first elastic portion than to the second elastic portion.

17. A feeding device as claimed in claim 11; wherein the slider is of one-piece construction.

18. A feeding device as claimed in 11; wherein the first and second elastic portions of the slider are pivotally connected to the respective fastening portion, intermediate body portion and slider body portion of the slider.

19. A feeding device as claimed in claim 11; further comprising an operating member movable in the axial direction of the tubular member, the operating member being connected to the slider for sliding the slider between the first and second directions during movement of the operating member only in the axial direction of the tubular member.

* * * * *